US007251870B2

(12) United States Patent
Nelson

(10) Patent No.: US 7,251,870 B2
(45) Date of Patent: Aug. 7, 2007

(54) CASKET MEMORIAL DRAPE AND DISPLAY

(76) Inventor: Linda J. Nelson, 318 W. 625 North, Lindon, UT (US) 84042

( * ) Notice: Subject to any disclaimer, the term of this patent is extended or adjusted under 35 U.S.C. 154(b) by 221 days.

(21) Appl. No.: 10/975,670

(22) Filed: Oct. 27, 2004

(65) Prior Publication Data

US 2005/0091810 A1 May 5, 2005

Related U.S. Application Data

(60) Provisional application No. 60/515,569, filed on Oct. 29, 2003.

(51) Int. Cl.
*A61G 17/00* (2006.01)

(52) U.S. Cl. ..... 27/19

(58) Field of Classification Search ..... 27/19, 27/2, 1; D99/8, 10; 40/606.03
See application file for complete search history.

(56) References Cited

U.S. PATENT DOCUMENTS 1,931,828 A * 10/1933 Overstreet ..... 27/19
2,112,882 A * 4/1938 Donnelly ..... 27/19
4,357,741 A * 11/1982 Winburn et al. ..... 27/19
5,601,900 A * 2/1997 Doscher ..... 428/149
5,678,289 A 10/1997 Saaf
D390,319 S 2/1998 Benedict et al.
5,813,099 A 9/1998 Stewart
D405,582 S 2/1999 Benedict et al.
D413,006 S 8/1999 Calhoun
6,467,634 B1 10/2002 Pinco
6,557,222 B2 5/2003 Groemminger et al.
6,691,385 B2 2/2004 Bell et al.
6,722,001 B2 4/2004 Baker
6,754,940 B1 6/2004 Boots
2004/0250389 A1 * 12/2004 Hooper et al. ..... 27/19

* cited by examiner

*Primary Examiner*—William L. Miller
(74) *Attorney, Agent, or Firm*—Everett D. Robinson; Parsons Behle & Latimer

(57) ABSTRACT

Disclosed herein are casket drape articles incorporating a message suitable for display on a casket and further suitable for retaining as a memorial keepsake of a deceased person. Detailed information on various example embodiments of the inventions are provided in the Detailed Description below, and the inventions are defined by the appended claims.

19 Claims, 3 Drawing Sheets

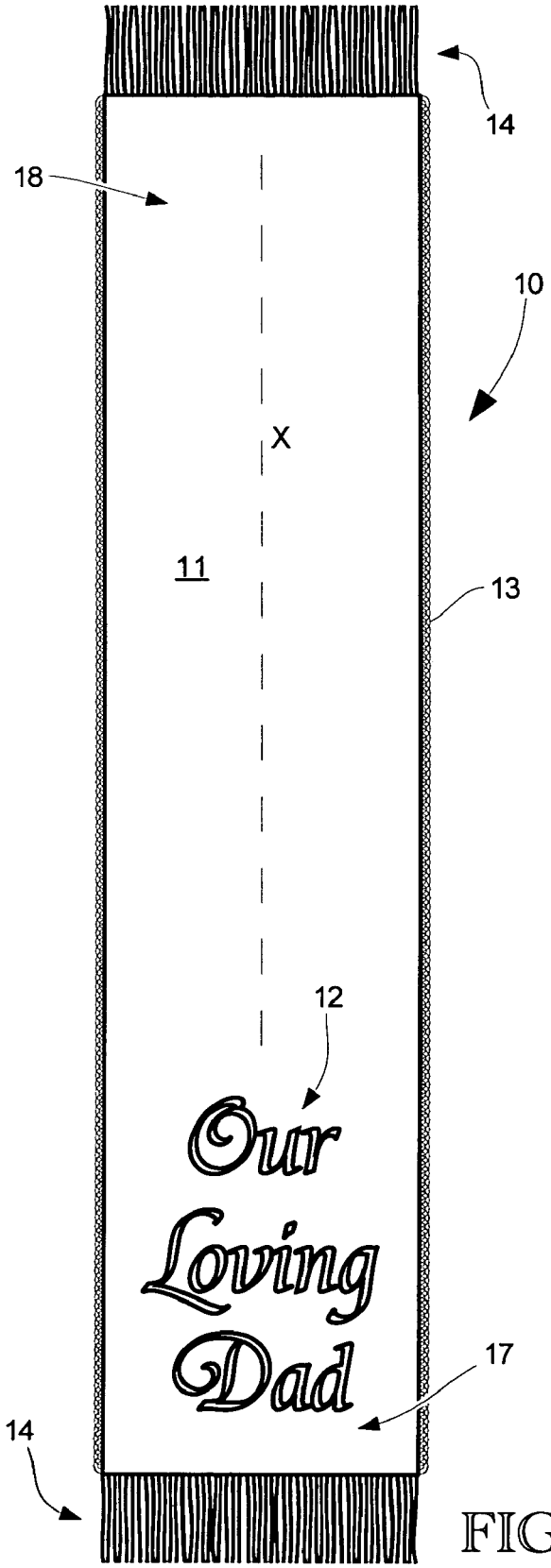
FIG. 1
FIG. 2
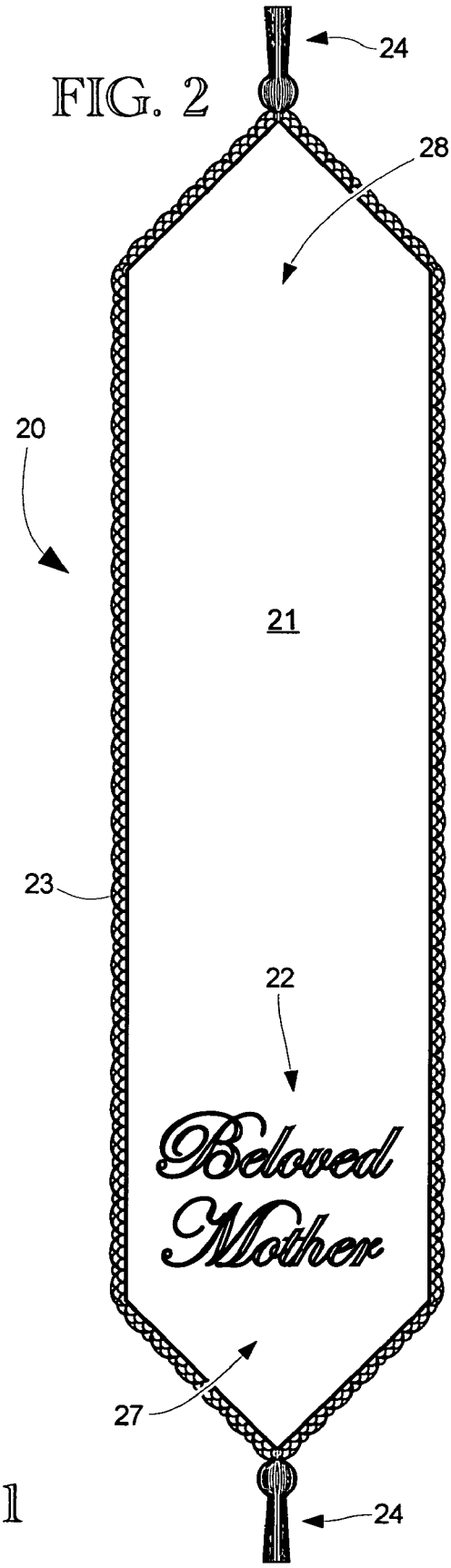

CASKET MEMORIAL DRAPE AND DISPLAY

CROSS REFERENCE TO RELATED APPLICATIONS

This Application claims the benefit of the U.S. Provisional Application No. 60/515,569 filed Oct. 29, 2003, which is hereby incorporated by reference in its entirety.

BACKGROUND

The claimed inventions relate generally to ornamentation for burial caskets and coffins, and more particularly to casket drape articles incorporating a message suitable for display on a casket and further suitable for retaining as a memorial keepsake of a deceased person.

Memorial services and ceremonies for deceased persons are as old as humanity itself. After a person has passed away, his friends, family and acquaintances may meet together to remember the individual, console one another and bid a final farewell to the departed. In common practice before burial, a viewing may be held to offer a final opportunity to look upon the deceased, usually followed by a graveside service. In both, the casket of an individual is displayed as a focal point in memorial services, with floral displays of well-wishers presented nearby. In some services, particularly if the deceased was a member of a state, a flag may be displayed over the casket, which may later be presented to a family member as a token of the deceased's services to his country.

Following most services, very little is left to take home in the way of objects of remembrance of the deceased. In most cases, the decorations and memorabilia of the services are disposable and/or perishable, with a few minor exceptions in the way of cards, programs and perhaps a guest book. Indeed, an inherent purpose is to leave little reminder of the deceased, perhaps with the purpose of minimizing the grief of loved-ones. Some, however, would prefer to retain objects of remembrance, for example in honor of the deceased. When a loved-one dies, a person may consider the deceased in a new light, and more fully understand and appreciate that person's character and beneficial acts of her life. A loved-one may wish to more frequently remember the deceased as an act of gratitude, or to make the deceased an exemplar of his own life.

Objects of remembrance may be especially scarce if the deceased was a victim of an accident or disaster, or was a traveller, soldier, prisoner or impoverished. Under such circumstances, survivors may wish to create objects of the deceased which they can later possess and treasure in remembrance of the deceased.

BRIEF SUMMARY

Disclosed herein are casket drape articles incorporating a message suitable for display on a casket and further suitable for retaining as a memorial keepsake of a deceased person. Detailed information on various example embodiments of the inventions are provided in the Detailed Description below, and the inventions are defined by the appended claims.

BRIEF DESCRIPTION OF THE DRAWINGS

FIG. 1 shows an exemplary casket drape article having squared ends as viewed from its presentation side.

FIG. 2 shows another exemplary casket drape article 20 with pointed ends and tassels.

Reference will now be made in detail to casket drape articles and uses thereof, which may include some more specific embodiments of the claimed inventions, examples of which are illustrated in the accompanying drawings.

DETAILED DESCRIPTION

Disclosed herein are articles of manufacture that may provide a dignified and optionally personalized decoration that maybe later kept as a remembrance of a deceased person. The article may be draped over a casket, coffin or other structure for housing the body of the deceased. (Hereinafter such a structure will be referred to as a casket for simplicity.) Those articles include a substantially planar and flexible substrate having a presentation face and a contact face, the presentation face having a visually attractive condition and the contact face configured to rest on a casket. The substrate may be fashioned from fabric, cloth, films and other flexible materials. The substrate may have a longitudinal axis, which axis may be positioned in relation to a displayed casket such that the article can be draped across the casket on its contact face, as shown generally in FIG. 4. In most ceremonies, one long side of a casket is displayed more prominently than the other, for example if the casket is positioned against a wall or other obstructing object. The ends of articles resting across so positioned caskets may be identified as the forward (prominent) end and the rearward (obscured) end, which ends are opposed along the longitudinal axis of the article (ends being not only the edge of the substrate but also a substantial portion thereof.) In other situations, a casket may be displayed with both long sides equally visible, in which case the identification of the article ends may be arbitrary.

Incorporated to the forward end of the article is a message, in the forms of words or visual representations, which relates to the deceased person. The message may be located to the article such that the message appears against or near a visible side of the casket, which location may be on the article's forward end. The message might include generic messages, for example sentiments such as "Loving Mother", "Our Little Angel", "Loving Son", "Loving Daughter" and the like. The message might also include poems, sayings, quotations, alma maters, symbols and other popular representations. Personalized information types might also be included, for example the name of the deceased, vital statistics such as dates of birth or death, insignias, a coats of arm, the names of survivors, and many other personal items of information.

Figure 4:
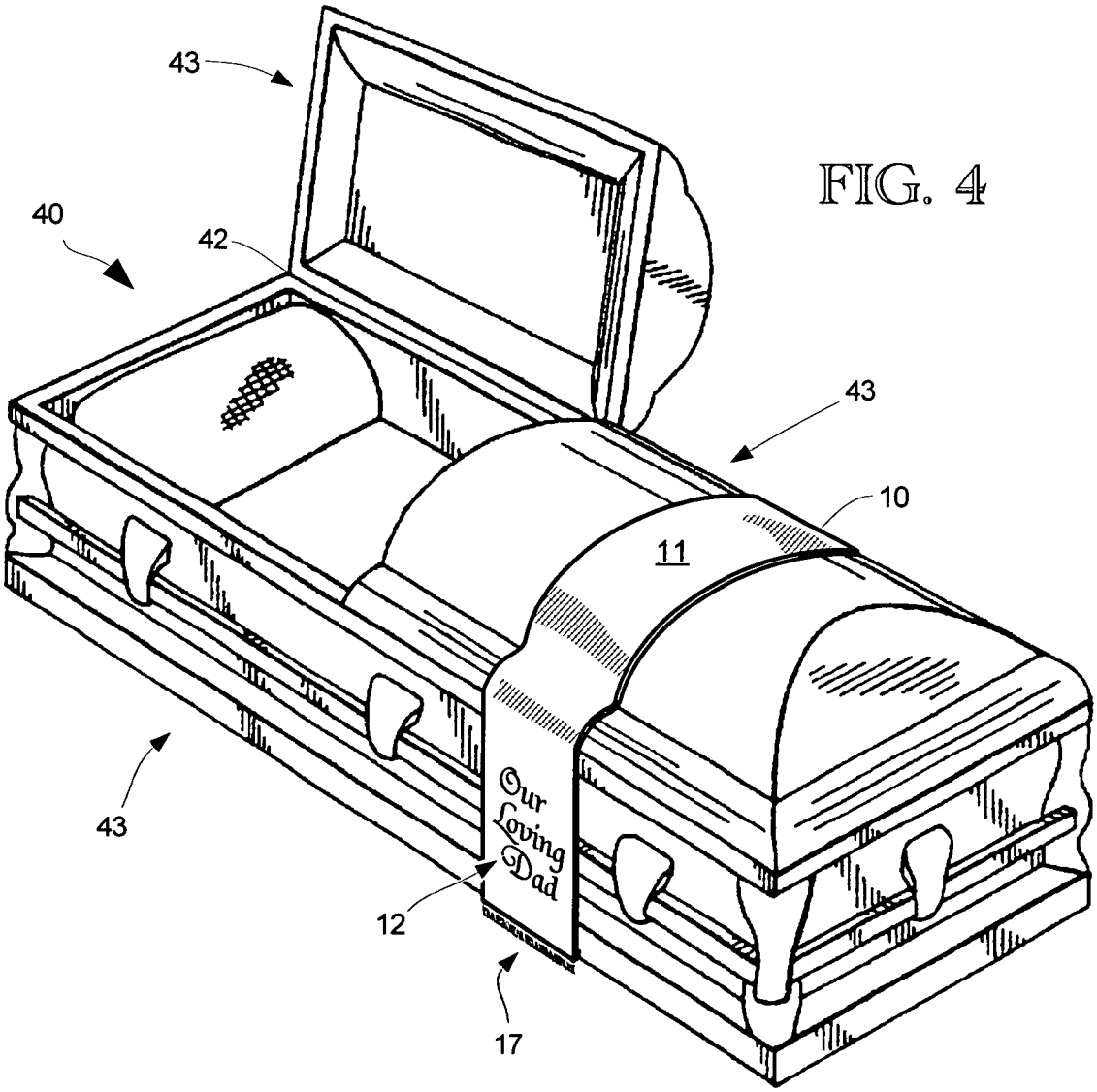
FIG. 4 shows the exemplary drape of FIG. 2 in a resting position over a casket.

Referring now to FIG. 1, an exemplary casket drape article 10 having squared ends is shown as viewed from its presentation side. Article 10 is fashioned from a substrate, a presentation face 11 visible in the drawing. A longitudinal axis marked "X" runs the length of article 10, which axis may placed substantially crosswise to the longitudinal axis of a casket, as shown in FIG. 4. Article 10 includes a forward end 17 and a rearward end 18, which provide an orientation of positioning for the article. Incorporated in forward end 17 is a message 12, in this example "Our Loving Dad". To provide a more finished and refined look, article 10 includes fringes 14 at the end terminations and trim 13 at the sides.

Article 10 may be draped across a casket 40 in a resting position, as shown in FIG. 4. In the resting position a substantial portion of presentation face 11 is visible to onlookers generally as shown. The exemplary casket 40 includes a forward facing side 43, generally and prominently visible. Casket 40 also includes a rearward-facing side 44, not shown, which may be visibly obscured. A lid 41 may be swung upward permitting viewing of the interior of casket 40 from a vantage near the forward facing side 43—lid 41 being attached by a hinge 42 to the rearward side of casket 40. Forward end 17 and message 12 are positioned to display the message conveniently to viewers of the forward-facing side of casket 40 while article 10 is in resting position, the message located near or against the facing side of the casket. After use, article 10, as with other casket drapes, may be retained as a keepsake and displayed on a wall or as a table covering.

Casket drape articles may be fashioned in many shapes and forms, as will become clear. In FIG. 2, another exemplary casket drape article 20 is depicted with pointed ends. As in the article of FIG. 1, article 20 has a presentation face 21, a forward end 27, a rearward end 28, and finishing trim 23, which in this example is lace. In this example, a message 22 includes the embroidered words "Beloved Mother". Further in article 20, the points of ends 27 and 28 are finished with tassels 24.

Figure 5:
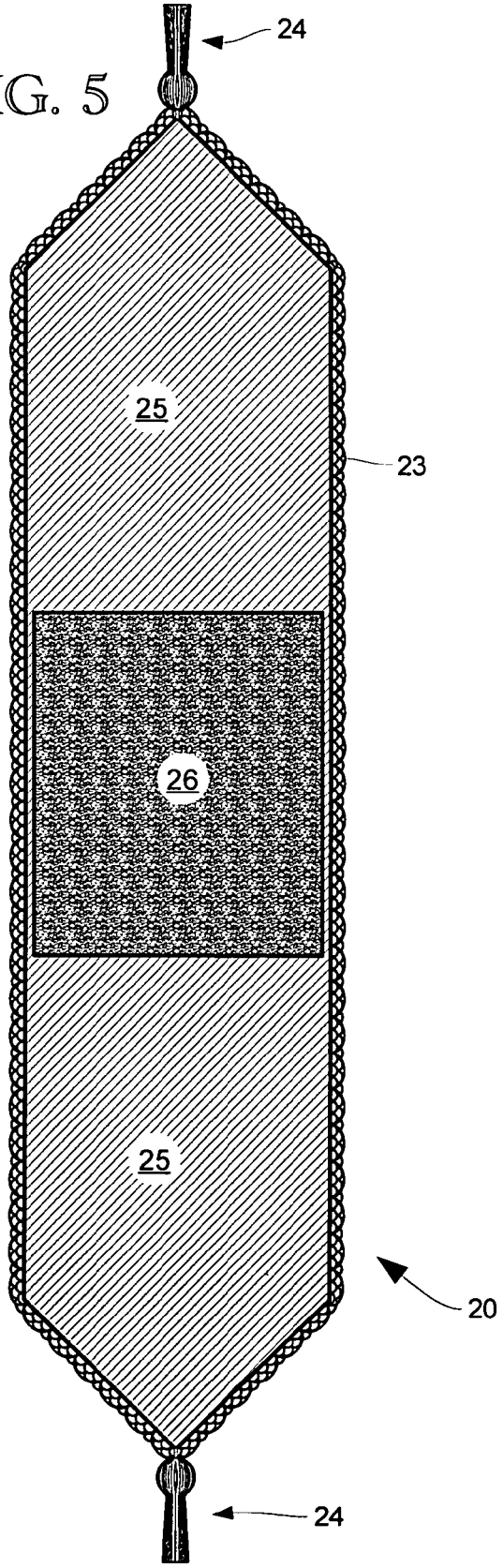
FIG. 5 shows the reverse or contact side of the article of FIG. 2.

Referring now to FIG. 5, the reverse side of article 20 of FIG. 2 is shown, including lace 23 and tassels 24 visible from both sides. A contact face 25 is provided to rest against the surface of a casket. A slip-resistant backing 26 is further applied to article 20, providing hold or adhesion of the article to the top of the casket, preventing the article from slipping off the potentially smooth surface of the casket top. The length of article 20 is chosen to permit the forward and rearward ends to terminate near the bottom of an adult-sized casket, when the article is in the resting position shown in FIG. 4.

Figure 6:
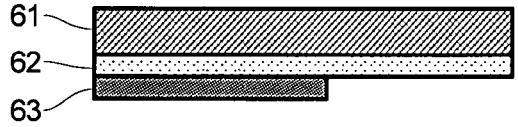
FIG. 6 illustrates a layered structure having two fabric layers and an anti-slip backing that may be used to form a casket drape substrate.

Now referring to FIG. 6, a layered structure is shown which forms the substrate of the article of FIGS. 2 and 5. In that example, a presentation layer 61 provides the presentation face 21 of the article, and is formed of a heavyweight and flexible material. The material forming layer 61 may be chosen for its resistance to bunching and wrinkling, and to provide a smooth and relatively stiff support for the subtrate. Materials having a weight suitable for draperies may generally be suitable to form the presentation layer 61, although it may be desirable to select unpatterned and smooth fabrics accepting to the application of a message 22, depending on the application method used. A material may optionally be incorporated into the substrate of sufficient weight to withstand air currents and gusts of wind, for example by increasing the weight of the material forming layer 61.

Many materials might be used to provide contact layer 62. If desired, a lightweight and inexpensive fabric in a neutral color may be chosen, if it is deemed unimportant to improve the unseen contact face. As contact layer 62 may rest and rub against the top of the casket, a non-marring material may be selected to avoid scuffing and scratching the finished surface of the casket. Suitable materials include silk, soft cotton, satins and other soft fabrics, plastic films and even waxed paper products. Contact layer 62 may be fashioned in a similar shape to presentation layer 61, effectively creating a liner for a casket drape article.

The exemplary substrate of FIG. 6 includes a slip resistant backing layer 63 on a portion of the contact side of the casket drape article. In the example of FIG. 5, layer 63 forms the slip-resistant backing 26, which covers about 18 inches of the length at the center of the contact layer 62 (of which face 25 is visible) along the length of the longitudinal axis. Patterned foam rubber anti-slip matting material, such as that widely available for shelf and drawer liners, makes a good anti-slip backing. Anti-slip films such as hard rubber, or films available from Dycem Limited of Warwick, R.I. may also be advantageously used. Other unmarring anti-slip materials may be likewise be chosen in accordance with adhesion, anti-slip and other characteristics as desired. Any of these materials may be generally used.

Figure 7:
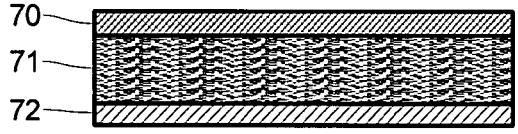
FIG. 7 depicts an alternate substrate structure having a presentation layer fashioned from a medium-weight fabric and a contact layer that includes an anti-slip material.

FIG. 7 depicts an alternate substrate structure that may be used. Presentation layer 70 is fashioned from a medium-weight fabric, providing an attractive background for messages incorporated thereto. Contact layer 72 is fashioned from a slip resistant material, for example vinyl, sheet rubber or other tacky material. A stable filler 71, for example a quilting batting product, is interposed between layers 70 and 72, providing body to the substrate structure. A similar structure might omit the filler, provide a heavyweight layer in one of layers 70 or 72, and utilize a slip-resistant material for contact layer 72 to eliminate the need for a separate slip-resistant backing layer.

Figure 8:
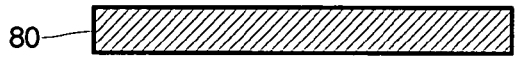
FIG. 8 depicts a substrate having a single layer formed of a slip-resistant and non-marring material.

Many other substrate configurations are possible and may be substituted as desired, provided the functional aspects of the substrate are retained. For example, in FIG. 8 a substrate is shown having a single layer 80 only, formed of a slip-resistant and non-marring material such as a heavyweight vinyl film. Decoration and a message might be screen printed on that layer, or adhesives might be similarly used to fasten a message thereto. Many materials might be used to form a substrate, including plastic or metallic films, weaves, or pressed filamentary materials such as felt. For luxurious feel or look sheer fabrics, silk or other attractive materials may be used. If it is desired to create a long-lasting article, materials having resistance to aging, ultra-violet exposure and moth resistance may be used, for example acrylic or polyolefin fabrics. Common materials such as polyester might make a relatively inexpensive yet relatively durable compromise.

Likewise, many methods of incorporating a message may be used, including printing, embroidery, embossing, thermal transfer, adhesive lettering, stenciling, flocking, an insert to a transparent pocket, or other method depending on the presentation face available. Additionally, although the examples above incorporate a message at one end of the casket drape, a message might be incorporated at both ends of the article, particularly if both ends are to be visible in use.

Figure 3:
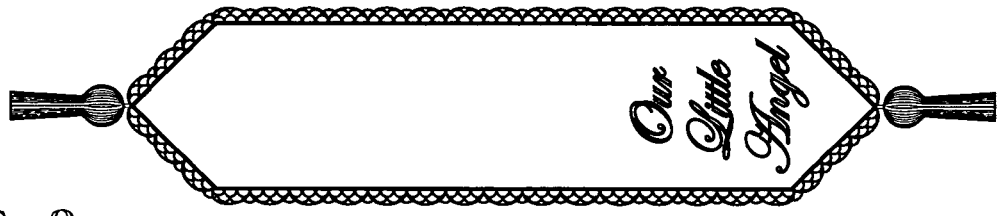
FIG. 3 shows a smaller casket drape article suitable for display over an infant-sized casket.

In the examplary casket drapes of FIGS. 1 and 2, the dimensions of the article are selected to be about 67 inches in length and about 15 inches in width, providing good length and proportion to an adult-sized casket. Shown in FIG. 3 is an infant-sized casket drape article, being about 38 inches in length and about 8.5 inches in width. Articles for other sized caskets may be fashioned, for example for a child or a large person, by maintaining generally the proportions of the articles described and shown. The disclosed dimensions and proportions, however, need not be rigidly adhered to, and may be varied according to the dictates of style and fashion.

For multi-layer substrates, many fastening methods may be used, for example stitching, serging, adhesives, embroidery, tacking, welding or other methods. Additionally, slip-resistant backings may be made thin or alternately tapered to avoid showing a bulge in the presentation surface. Although lace, tassels and trim are specifically shown in the examples, other finishing details may be used, for example braid, embroidery, beads and others. Additionally, findings may also be included, for example grommets or hooks to hang the drape on a wall, or storage findings such as ties, snaps, or buttons. Colors may be selected as desired for the article, however it may be desired to choose warm, tasteful colors to promote warm and dignified impressions.

While casket memorial drapes have been described and illustrated in conjunction with a number of specific configurations and methods, those skilled in the art will appreciate that variations and modifications may be made without departing from the principles herein illustrated, described, and claimed. The present invention, as defined by the appended claims, may be embodied in other specific forms without departing from its spirit or essential characteristics. The configurations described herein are to be considered in all respects as only illustrative, and not restrictive. All changes which come within the meaning and range of equivalency of the claims are to be embraced within their scope.

What is claimed is:

1. A memorial drape article for setting on a displayed burial casket or coffin, comprising:

a flexible presentation layer, said presentation layer fashioned from fabric;

a flexible contact layer attached to said presentation layer, said contract layer having a shape substantially identical to the shape of said presentation layer, said contact layer further being fashioned from non-marring fabric;

a slip resistant backing attached to said contact layer;

wherein said presentation layer and said attached contact layer form a substantially planar substrate having a forward and rearward end disposed at opposite ends of said substrate along a longitudinal axis;

whereby said article is configured to lay across the displayed burial casket or coffin in a resting position, the resting position presenting said slip resistant backing to a top of the casket or coffin, the resting position further presenting a substantial portion of said presentation layer to view, the resting position further orienting said forward end to rest against a visible side of the casket or coffin;

wherein a message is incorporated to said presentation layer in a position such that said message is visible and located near the visible side of the casket or coffin when said article is in the resting position; and wherein one of said presentation layer and said contact layer includes heavyweight fabric.

2. An article according to claim 1, wherein each of said presentation, contact, and slip resistant layers are distinct layers.

3. An article according to claim 1, wherein at least two of said presentation, contact, and slip resistant layers are an identical layer fashioned from the same piece of material.

4. An article according to claim 1, wherein said message is selected from the group consisting of popular poems, sayings, quotations and alma maters.

5. An article according to claim 1, wherein said message includes information selected from the group consisting of a name of a deceased person, a date of birth, a date of death, a coat of arms, and a name of a survivor.

6. A display for memorializing a deceased person including a drape article incorporating a message, the drape article suitable for providing a durable keepsake after display, the display comprising:

a burial casket or coffin;

the drape article resting on said casket or coffin in a resting position, said article including a flexible substrate, said substrate being substantially planar and further having a presentation face and a contact face, said substrate further having a forward and rearward end disposed at opposite ends of said substrate along a longitudinal axis, whereby said article is configured to lay across said casket or coffin in the resting position, the resting position presenting said contact face to said casket or coffin, the resting position further presenting a substantial portion of said presentation face to view, the resting position further orienting said forward end to rest against a visible side of said casket or coffin, the article further incorporating a slip-resistant backing; and wherein a message is incorporated to said substrate toward said forward end such that said message is visible and located near the visible side of said casket or coffin when said article is in the resting position.

7. An article according to claim 6, wherein said message is selected from the group consisting of popular poems, sayings, quotations and alma maters.

8. An article according to claim 6, wherein said message includes information selected from the group consisting of a name of a deceased person, a date of birth, a date of death, a coat of arms, and a name of a survivor.

9. A display according to claim 6, wherein said message includes an item of personal information of the person for which said display is intended.

10. A display according to claim 6, wherein said substrate has a length in the direction of said longitudinal axis to permit said forward and said rearward ends to terminate near a bottom of said casket or coffin.

11. A display according to claim 6, wherein said substrate includes a fabric.

12. A memorial drape article for providing a memorial presentation on a displayed burial casket or coffin, the article further providing a durable keepsake after display, comprising:

a flexible substrate, said substrate being substantially planar and further having a presentation face and a slip-resistant contact face, said substrate further having a forward and rearward end disposed at opposite ends of said substrate along a longitudinal axis;

whereby said article is configured to lay across the displayed burial casket or coffin in a resting position, the resting position presenting said contact face to the casket or coffin, the resting position further presenting a substantial portion of said presentation face to view, the resting position further orienting said forward end to rest against a visible side of the casket or coffin;

whereby said substrate has a length in the direction of said longitudinal axis to permit said forward and said rearward ends to terminate near a bottom of the casket or coffin when said article is in the resting position;

wherein a message is incorporated to said substrate toward said forward end such that said message is visible and located near the visible side of the casket or coffin when said article is in the resting position.

13. An article according to claim 12, wherein said substrate has a length in the direction of said longitudinal axis to permit said forward and said rearward ends to terminate near a bottom of the casket or coffin, the casket being adult-sized.

14. An article according to claim 12, wherein said substrate has a length in the direction of said longitudinal axis to permit said forward and said rearward ends to terminate near a bottom of the casket or coffin, the casket being child or infant-sized.

15. An article according to claim 12, wherein said substrate includes a fabric.

16. An article according to claim 12, wherein said substrate includes a heavyweight fabric.

17. An article according to claim 12, wherein the length of said substrate is at least twice the width of said article.

18. An article according to claim 12, wherein the length of said substrate is about 67 inches in length to accommodate an adult-sized casket.

19. An article according to claim 12, wherein the length of said substrate is about 38 inches in length to accommodate an infant-sized casket.

* * * * *